United States Patent [19]

Shaw

[11] Patent Number: 4,657,114

[45] Date of Patent: Apr. 14, 1987

[54] BRIDGE PICKUP FOR STRING INSTRUMENT

[75] Inventor: Timothy P. Shaw, Kalamazoo, Mich.

[73] Assignee: Gibson Guitar Corp., Wilmington, Del.

[21] Appl. No.: 716,410

[22] Filed: Mar. 27, 1985

[51] Int. Cl.[4] ..... G10H 3/18

[52] U.S. Cl. ..... 84/1.16; 84/DIG. 24

[58] Field of Search ..... 84/1.16, 1.14, DIG. 24; 310/340, 348, 349, 340; 339/17 CF; 361/380, 393, 394, 395

[56] References Cited

U.S. PATENT DOCUMENTS

| | | | |
|---|---|---|---|
| 3,712,951 | 1/1973 | Rickard | 84/1.16 |
| 4,189,969 | 2/1980 | Katayama et al. | 84/1.14 |
| 4,314,495 | 2/1982 | Baggs | 84/1.16 |

*Primary Examiner*—William B. Perkey

*Attorney, Agent, or Firm*—Laney, Dougherty, Hessin & Beavers

[57] ABSTRACT

A bridge pickup for a string instrument includes a sensor assembly mounted in a U-shaped base. The sensor assembly includes a cast member encapsulating a holding means which holds an array of piezo sensor elements. The cast member extends below the sensor elements and includes an upper crest portion for supporting the strings of the instrument. A groove formed in the cast member at a point below the sensor elements extends to the lower electrode contact faces of the sensor elements, and a conductor placed in the groove provides an output. A U-shaped channel holds the sensor assembly and the conductor. Preferred conductive and casting materials are shown, and a method of manufacture is described.

13 Claims, 5 Drawing Figures

BRIDGE PICKUP FOR STRING INSTRUMENT

FIELD OF THE INVENTION

The present invention relates to transducers for converting the vibration of the strings of a musical instrument into electrical signals, and more particularly to bridge pickups having a saddle directly contacting the strings.

A number of pickup devices incorporated in an instrument bridge are known in the art. Among these, U.S. Pat. No. 4,189,969 issued Feb. 26, 1980, for an invention of S. Katayama et al., shows a pickup assembly with individually potted piezoelectric sensor elements having T-slots for receiving interchangeable crest elements for contacting the strings. U.S. Pat. No. 4,314,495 issued Feb. 9, 1982, for an invention of L. Baggs shows an elongated shielded piezoelectric crystal structure mounting within a saddle member U.S. Pat. No. 3,712,951 issued Jan. 23, 1973, for an invention of J. Rickard shows a bridge pickup with a separate movable saddle element for each string. Various other structures are shown in U.S. Pat. Nos. 3,154,701 of Evans; 4,252,990 of Sado; 4,278,000 of Saito et al.; 4,290,331 of Izdebski; 4,378,721 of Kaneko et al.; 4,380,357 of Evans et al.; and 4,160,401 of Tomioka.

As a rule, a central design problem of any pickup is that of obtaining both a faithful signal and a good signal to noise ratio. In a piezoelectric pickup this problem gains special dimensions because the pickup is "contact" pickup and the signal is generated by the direct action of compression waves transmitted through the piezo crystal element(s) via a coupling structure such as the saddle element of a bridge. Both the physical geometry and the mechanical/acoustic properties of the coupling structure thus become quite important. Ideally the transfer of energy from the string through the coupling structure to the sensor elements should not color the sound, and should be relatively efficient independently of the variations in construction or adjustment of the different strings which may be used on the instrument.

SUMMARY OF THE INVENTION

The present invention provides a novel structure for a bridge pickup for a string instrument in which a sensor assembly mounts in a base member. The sensor assembly comprises a cast member encapsulating a holding means holding a plurality of sensor elements. The cast member has an upper crest portion for receiving the vibrations of the instrument strings and transmitting them to the sensor elements, and extends to a lower portion below the sensor elements. The lower portion has a groove extending therethrough to an electrode contact surface of the sensor elements. Conductive means extending through the groove provides an output from the sensor assembly. Preferably the cast member is formed of a curable polymer having a cured hardness in the range of 80–85 on the Shore D scale. In a preferred embodiment, the holding means engages the upper surface of the sensor elements and defines an air gap between that surface and the crest portion. In a further preferred embodiment, the conductive means includes a PC board held in registry with the the sensor elements between the cast member and the base, and also includes a compressible unidirectionally conductive medium, disposed in the groove and connecting the sensor elements to the PC board. A method of assembling the pickup is shown.

BRIEF DESCRIPTION OF THE DRAWINGS

These and other features of the invention will be more fully appreciated by reference to the drawings, in which.

DETAILED DESCRIPTION

Figure 1:
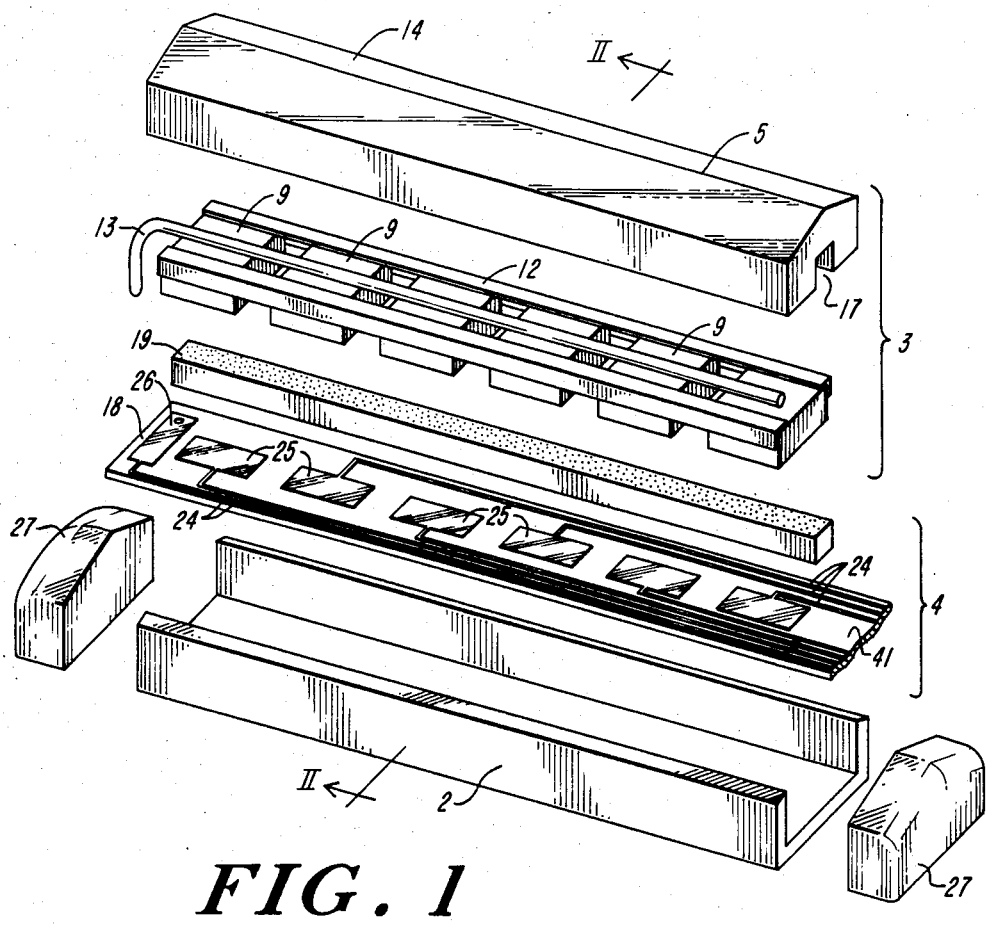
FIG. 1 shows an exploded view of a pickup according to the present invention.

FIG. 1 shows an exploded view of the pickup 1 of the present invention, having a base 2, a sensor assembly 3 and conductive means 4. Base 2 comprises a U-shaped conductive channel which serves as a ground and a partial shield for the pickup. The channel may be, for instance, an aluminum extrusion. The sensor assembly 3 includes a cast polymer member 14 and a plurality of piezoelectric sensor elements 9 held in an array by frame 12 encapsulated within the member. Sensor assembly 3 and a mating PC board 18 fit within the U-shaped conductive channel 2. A ribbon cable 41 exits from an end of the base to carry the pickup signal to an external device.

During manufacture of the preferred embodiment, member 14 is cast around the array of sensors, with a groove 17 formed in the underside of the cast member and extending to a lower contact face (11, FIG. 3) of the sensor elements. A compressible conductor (19, FIGS. 2 and 3) is placed in the groove 17. The sensor assembly 3 and the conductive means 4 are then cemented in the channel 2, resulting in a pickup unit 1 that is closed on all sides, having a high degree of protection from atmospheric degradation of the enclosed sensor elements. This method of assembly involves no injection molding or other pressurized manufacturing steps which might introduce irregular stresses or unanticipated displacements of the sensors during manufacture. It thus permits the consistent fault-free manufacture of pickups having relatively uniform output and response characteristics.

As shown in FIG. 1, the sensors 9 are held in a generally longitudinal spaced configuration by a pair of rails 12, which may be, for example, L-shaped members formed of an ABS plastic and cemented to the sensor elements. A common conductor 13 interconnects a face of each sensor. The precise number of sensors and their spacing will correspond to the number and spacing of the strings of the instrument for which the pickup is intended. The pickup shown in FIG. 1 has 6 sensors arranged for a 6-string guitar, or for a 12-string guitar with six similarly spaced pairs of strings. For assembly, the array consisting of the sensors 9 and rails 12 is placed in a mold having a mold surface in the shape of the top of an instrument bridge. A curable casting polymer is poured into the mold so as to form cast member 14 with the array encapsulated therein. Cast member 14 is formed with a groove 17 therein extending to the electrode surfaces of the embedded sensor elements. When cured, member 14 together with the embedded array, which collectively form the sensor assembly 3, is removed from the mold and its lower surface is filed or milled flat. A conductive means accesses the sensor elements through the groove. Preferably the conductive means includes a monodirectionally conductive strip 19, which may be of the type formed of a compressible elastomer matrix having thin conductive wires extending transversely therethrough from the top to the bottom surface thereof, and also includes a PC board 18, in registry with the sensor elements. As shown in FIG. 1, PC board 18 is a flexible PC board, integrally formed with ribbon cable 41 which provides an output. Board 18 includes conductive leads or paths 24 each terminating in a conductive land 25 underlying a respective one of the sensors. A further land 26 is provided for connection to the upper conductor 13 which serves as a common or ground lead for the sensors.

The pickup unit is assembled by placing conductive strip 19 in groove 17, and then placing the sensor assembly 3 over the PC board in channel 2. In this manner a precisely aligned array of sensors is sealed in a stress-free mounting to form the pickup. Preferably the sensor assembly 3 is cemented in the channel. An end cap 27 is then placed at each end of the assembly and sealed thereto.

The completed pickup has a ridge 5 along its top surface upon which the strings of the musical instrument rest. In use, the vibrational energy of each string is transmitted from its point of contact with ridge 5, through the upper or crest portion of the sensor assembly, to the sensor elements within, which are located centrally below the strings. The present invention provides a novel structure for supporting such sensor elements within a saddle member in a manner to provide both a reasonable degree of acoustic isolation from the instrument body and a good coupling to the overlying strings, as will now be discussed in relation to FIG. 2.

Figure 2:
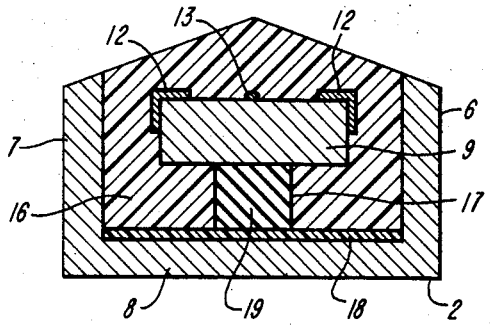
FIG. 2 shows a cross section of the pickup.

FIG. 2 shows a cross section through the pickup 1 along the plane II—II of FIG. 1, and passing through a piezo element. As shown, a piezo sensor element 9 having upper electrode contact surface 10 and lower electrode contact surface 11 is held in registration, with respect to a plurality of other such sensor elements, by a holding means or frame 12. Frame 12 is shown as a pair of I-shaped smembers orienting the sensors along a common planar strip, but may alternatively comprise a molded ladder-shaped structure having spaced apertures formed therein for receiving the sensor elements and holding them at predetermined spacings or heights corresponding to the positions of the strings of the instrument on which the pickup is to be used. A conductor 13, which may be a wire, as shown, or a conductive strip, electrically interconnects the upper electrode surface of the sensor element with the other sensor elements of the pickup. Finally cast member 14, having a crest portion 15 generally overlying the piezo elements and extending down to a portion 16 below the piezo elements, encapsulates the frame and piezo elements. Member 14 includes opposing side walls and is preferably formed by inverting the frame/sensor element assembly in a jig and then casting member 14 in a mold as a block around the frame. A removable strip is placed on the sensors before pouring the member, so as to form, when removed, a groove 17 in the molded block, exposing the lower electrode contact surfaces 11 of the piezo elements. Cast member 14 together with the sensor array thus forms a unitary sensor assembly 3.

Figure 3:
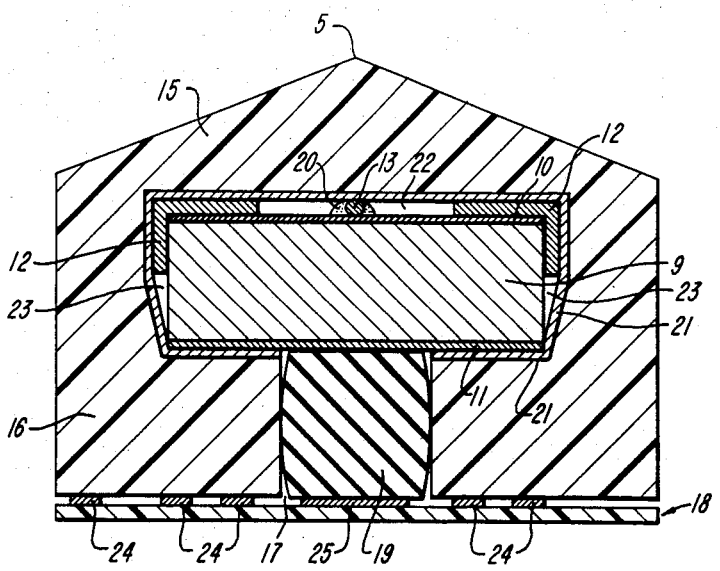
FIG. 3 shows an enlarged cross section of a preferred embodiment of the sensor assembly.

As noted above, the upper region or crest portion 15 of the cast member has an apex or ridge 5 along is upper surface serving as a bridge to transmit the vibrations of the strings to the piezo elements. It will be observed that frame 12 protrudes outwardly from the edges of the piezo elements 9, so that crest portion 15 is quite thin at the sides thereof where it joins to the side walls of the cast member. Moreover the crest portion approaches a direct contact with the piezo element only in the central region of the top electrode contact surface. This structure has been found to result in good tonal pickup qualities, substantially free of adverse tone coloration from the internal acoustics of cast member 14. FIG. 3 shows a cross section of a portion of a further preferred embodiment of the invention, in which an air gap 22 is provided between the crest portion and the piezo element to further enhance tonal quality.

FIG. 3 shows a section corresponding to FIG. 2 but of a preferred embodiment of the cast member and conductor assembly. In this embodiment piezo element 9, frame 12 and conductor 13 are substantially as shown in FIG. 2. Upper and lower electrode contact surfaces 10, 11 are preferably metallized, and conductor 13 is soldered to upper surface 10 by solder 20. A sheet material or tape 21 is then wrapped around the frame/sensor elements before pouring the cast member 14, so that when the casting polymer is poured into the mold, an air gap 22 is created in the upper central region of the electrode contact surface. The cast member 14 is then formed with groove 17 therein, and cured, as before, and the tape 21 at the bottom of the groove is cut away to expose the lower electrode surfaces.

It has been found that by forming air gap 22 between the crest portion and the piezo element a truer tone is produced by the piezo elements, free of harshness. In prototype pickups constructed according to this embodiment of the invention, the air gap 22 has a depth, between the electrode surface and the lower surface of the crest, in the range of 0.25–1.25 mm, and extends for a width of 1–2 mm between the opposing rails of frame 12. The taping produces other air gaps 23, of comparable dimensions, during the casting of member 14, which serve to isolate the lateral portions of the sensor element from the cast member, and which may also contribute to this enhanced tonal quality. As before, connector 19 interconnects the piezo elements to the PC board 18, providing an output from the pickup. Also shown in FIG. 3 are conductive lines 24 on the surface of the PC board, and a wider conductive land 25, located in registry with the electrodes of piezo element 9, for contacting connector 19. In the embodiment shown in FIG. 1 there are 7 conductive lines, one ground plus one line for each of 6 conductive leads required for a 6-string guitar pickup having 6 piezo elements. In the section of FIG. 3, corresponding to the section II—II of FIG. 1, there are shown five of these lines 24, corresponding to the sensors underlying strings 3–6, plus the ground wire. In this embodiment PC board 18 is a flexible PC board, integrally formed with a ribbon cable (41,FIG. 1) which exits from one end of the pickup assembly to connect to a jack or a controller mounted on the guitar. The base member (not shown) of this embodiment is similar to that of FIG. 2, and accordingly further details thereof are omitted.

Figure 4:
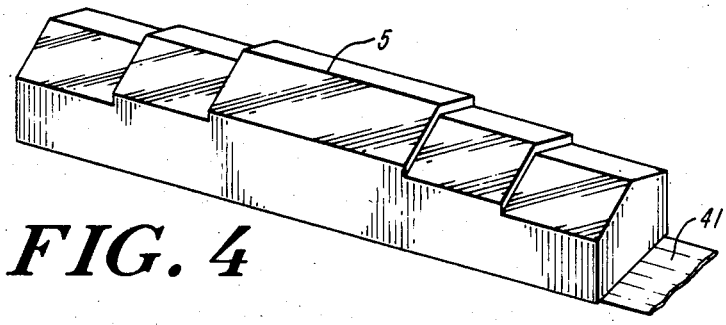
FIG. 4 shows a perspective view of an alternative embodiment.
Figure 4A:
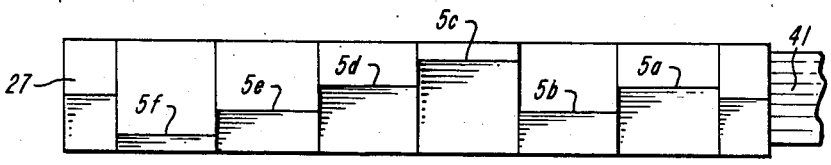
FIG. 4A shows a top view of another alternative embodiment of the pickup.

FIG. 4 shows a perspective view of another embodiment of the present invention. As shown, ridge 5 in this embodiment is stepped, so as to provide a bridge having a different height for different strings. It is also possible to form the ridge portion for each string slightly offset along the axis of the string to adjust the intonation of the instrument, in a manner known in the art. FIG. 4A shows a top view of an embodiment of the invention having such a ridge. As shown, ridge 5 includes a plurality of adjacent ridge segments 5*a*, 5*b* . . . 5*f* each slightly offset along the string axis.

In regard to the materials used in constructing the pickup, it is noted that cast member 14 must be sufficiently hard to support the strings of the instrument without having grooves worn or pressed into the bridge, yet must not have the sort of brittle hardness which causes harsh internal acoustic effects, and must to some extent dampen internal accoustic vibrations emanating from the instrument body. I have found that by forming cast member 14 from a curable epoxy resin having a cured Shore D durometer of 75–90, and preferably in the range of 80–85, good results are obtained. The cast assembly may be cemented to the base using a cyanoacrylate or similar glue. End caps may be installed in the channel, and casting imperfections may be filled or sealed with an epoxy, a curable silicone sealer, or other compound.

It is also noted that the use of a conductive channel member for a base, grounded to the upper electrode contact surface of the piezo elements, provides, together with the upper electrode surfaces, a partial Faraday cage shielding the lower electrodes and their conductors from extraneous electrical or electromagnetic signals. Such partial shielding is enhanced by the placement of conductor 19 centrally under the upper electrodes, and further by the placement of the PC board 18 at the very base of the channel, adjacent to floor 8. In this manner the preferred construction of the present invention is substantially shielded from ambient noise.

It will be appreciated that while the invention has been described with reference to certain preferred embodiments, such description is by way of illustration, and the invention is not limited thereto. The invention having been thus described, variations may be made therein by those skilled in the art, and all such variations shall be within the spirit of the invention, as limited only by the following claims.

What is claimed is:

1. A bridge pickup for an instrument having strings, such pickup comprising:

a plurality of piezo sensor elements, each element having an upper and a lower electrode contact face;

a holding means, for holding the sensor elements in a fixed generally elongate spatial array;

a generally elongate cast member encapsulating the sensor elements and the holding means so as to form a unitary sensor assembly, said cast member including an upper crest portion above the upper contact faces for contacting the strings of the instrument and transmitting vibrations therefrom to the sensor elements below, said cast member further having a groove therein at a portion thereof below the sensor elements, such groove extending to the lower contact faces of the sensor elements;

conductive means for providing an output from the sensor elements; and base means defining a channel for fixedly receiving the sensor assembly and conductive means therein.

2. A pickup according to claim 1, further including an air gap formed between the upper contact faces and the cast member.

3. A pickup according to claim 2, wherein the conductive means includes a PC board held between the cast member and the base means, and further includes a compressible conductor located in the groove for interconnecting the lower faces of the sensor elements with the PC board.

4. A pickup according to claim 3, wherein the cast member is formed of a curable casting polymer having a cured hardness in the range of approximately 75–90 durometer on a Shore D scale.

5. A pickup according to claim 4, wherein the base member is formed of conductive material and wherein the upper contact faces are conductively interconnected to the base member so as to form a partial Faraday cage about the sensor elements.

6. A pickup according to claim 5, wherein the upper crest portion includes a stepped ridge with each step approximately centered under a group consisting of at least one string.

7. A pickup according to claim 6, wherein the ridge comprises a plurality of offset ridge segments.

8. A pickup according to claim 1, wherein the conductive means includes a PC board between the cast member and the base means, the further includes a compressible conductor located in the groove for interconnecting the lower faces of the sensor elements with the PC board.

9. A pickup according to claim 1, wherein the cast member is formed of a curable casting polymer having a cured hardness in the range of approximately 75–90 durometer on a Shore D scale.

10. A pickup according to claim 9, wherein the casting polymer has a Shore D durometer in the range of approximately 80–85.

11. A pickup according to claim 1, wherein the base member is formed of conductive material and wherein the upper contact faces are conductively interconnected to the base member so as to form a partial Faraday cage about the sensor elements.

12. A pickup according to claim 1, wherein the upper crest portion includes a stepped ridge with each step approximately centered under a group consisting of at least one string.

13. A pickup according to claim 1, wherein the upper crest portion includes a ridge having a plurality of ridge segments offset along the axis of the strings.

* * * * *